United States Patent [19]

Hongo et al.

[11] Patent Number: 5,044,930

[45] Date of Patent: Sep. 3, 1991

[54] PULSE COMBUSTION APPARATUS

[75] Inventors: Ichiro Hongo, Yokohama; Kazuo Saito, Fujisawa; Akio Mitani, Fuji, all of Japan

[73] Assignee: Kabushiki Kaisha Toshiba, Kawasaki, Japan

[21] Appl. No.: 503,475

[22] Filed: Mar. 28, 1990

[30] Foreign Application Priority Data

Mar. 31, 1989 [JP] Japan ..... 1-83701

[51] Int. Cl.[5] ..... F23C 11/04

[52] U.S. Cl. ..... 431/1; 431/12; 431/114

[58] Field of Search ..... 431/1, 12, 114, 350 R; 122/17, 24; 237/59

[56] References Cited

U.S. PATENT DOCUMENTS

| | | | |
|---|---|---|---|
| 4,045,157 | 8/1977 | Peterson | 431/114 |
| 4,439,134 | 3/1984 | Olsson | 431/1 |
| 4,479,484 | 10/1984 | Davis | 431/1 X |
| 4,639,208 | 1/1987 | Inui et al. . | |
| 4,642,046 | 2/1987 | Saito et al. | 431/1 X |
| 4,840,558 | 6/1989 | Saito et al. . | |

OTHER PUBLICATIONS

S. T. Vogt, M. S. Yen, Dr. R. J. Schoenhals, Dr. Werner Soedel, "Performance of a Pulse Combustion Gas--Fired Water Heater", (ASHRAE Transactions), vol. 86, Part 1, pp. 126–141 (1980).

A. A. Putnam, F. E. Belles, J.A.C. Kentfield, "Pulse Combustion", (Prog. Energy Combustion Science), vol. 12, pp. 43–79 (1986).

*Primary Examiner*—Larry Jones

*Attorney, Agent, or Firm*—Cushman, Darby & Cushman

[57] ABSTRACT

A pulse combustion apparatus comprising a metal pipe member, an exhaust chamber, and an insert member. The pipe member has two open ends and its inner diameter is uniform over its entire length. The first open end of the pipe member is closed, and the second open end thereof is connected to the exhaust chamber. The insert member is located within the pipe member such that it and the pipe member define a combustion chamber within the pipe member, close to the first end thereof, and also an exhaust passage connecting the combustion chamber to the exhaust chamber and having a cross section area smaller than that of the combustion chamber. The combustion chamber and the exhaust passage constitute a Helmholtz resonator which realizes pulse combustion of the fuel gas.

10 Claims, 13 Drawing Sheets

PULSE COMBUSTION APPARATUS

BACKGROUND OF THE INVENTION

1. Field of the Invention

The present invention relates to a pulse combustion apparatus for use as a heat source in a water heater.

2. Description of the Related Art

A pulse combustion apparatus is advantageous over ordinary combustion apparatuses in two respects. First, it has high thermal efficiency; second, its exhaust gas has low toxicity.

The conventional pulse combustion apparatus comprises a combustion chamber having an exhaust port, a fuel-supplying system connected to the combustion chamber for supplying fuel gas thereinto, an air-supplying system connected to the combustion chamber for supplying air thereinto, a tail pipe connected to the exhaust port of the combustion chamber, two flapper valves incorporated respectively in the fuel-supplying system and the air-supplying system, and an ignitor incorporated in the combustion chamber for igniting a mixture gas in the combustion chamber, thereby starting combustion therein.

When ignited, the mixture gas in the combustion chamber explodes, raising the pressure in the chamber and automatically closing the flapper valves. At the same time, the combustion gas flows at high speed from the chamber through the exhaust port. The gas is then exhausted into the atmosphere through the tail pipe. As a result of this, the pressure in the combustion chamber decreases to a negative value, causing the flapper valves open by themselves, allowing the fuel gas and air to flow into the combustion chamber from the fuel-supplying system and the air-supplying system. When a specific amount of fuel gas and a specific amount of air have been supplied into the chamber and mixed together, the resultant gas mixture ignites and explodes by virtue of residual flames.

Thereafter, the fuel-air mixture is repeatedly combusted as long as the fuel-supplying system and the air-supplying system keep supplying fuel gas and air to the combustion chamber. The combustion gas in the tail pipe makes an oscillating flow having a large amplitude. Hence, more heat is transmitted from the tail pipe than in the case where the gas makes a steady flow. In addition, since the fuel is intermittently combusted in the combustion chamber, the amount of nitrogen oxides formed is small. The heat generated by the repeated combustions is collected from the outer periphery of the combustion chamber and also from the outer periphery of the tail pipe.

In most pulse combustion apparatuses, the tail pipe has a cross section area smaller than that of the combustion chamber. In other words, the inner diameter of the tail pipe is much smaller than that of the combustion chamber. This is because the tail pipe and the combustion chamber constitute a Helmholtz resonator. The resonator can be regarded, theoretically at least, as comprised of a mass and a spring. The mass is the gas in the tail pipe, and the spring is the gas in the combustion chamber. Further, the source of resonance is the intermittent explosion occurring in the combustion chamber. The resonant frequency f of this pulse combustion apparatus is given:

$$f = \frac{1}{2\pi} a \sqrt{\frac{S}{Vl}}$$

where a is the mean velocity (m/s) of sound in the tail pipe, s is the cross section area ($m^2$) of the tail pipe, V is the volume ($m^2$) of the combustion chamber, and l is the length (m) of the tail pipe.

The pulse combustion apparatus, described above, is disadvantageous in the following respects.

First, since the tail pipe has a small cross section area and, thus, a small inner surface, heat cannot be transmitted through the wall of the pipe with high efficiency. (In other words, the amount of heat transmitted through the wall of the tail pipe is small.) To increase the heat-transmitting efficiency, a secondary heat exchanger is located downstream of the tail pipe and collects the heat which cannot be collected through the wall of the tail pipe. The use of the secondary heat exchanger, however, makes the apparatus not only large but also expensive.

Secondly, the tail pipe, which has an inner diameter far smaller than that of the combustion chamber, is connected to the combustion chamber by means of a conical pipe so that the combustion gas can smoothly flow from the chamber to the tail pipe. The tail pipe, the chamber, and the conical pipe are integrated, forming a one-piece component. In most cases, this component is made by stamping an aluminum plate by using two stamping dies, one for forming the tail pipe and the other for forming the combination of the chamber and the conical pipe. Either stamping die is expensive, and stamping is a time-consuming process. It is inevitably expensive to manufacture said one-piece component.

SUMMARY OF THE INVENTION

The object of the present invention is to provide a pulse combustion apparatus which has a tail pipe having a large heat-transmitting surface, therefore requiring no secondary heat exchangers, and which can be made small and easy to manufacture.

Additional objects and advantages of the invention will be set forth in the description which follows, and in part will be obvious from the description, or may be learned by practicing the invention. The objects and advantages of the invention may be realized and obtained by means of the instrumentalities and combinations, particularly those pointed out in the appended claims.

According to the invention, there is provided a pulse combustion apparatus comprising a metal pipe member, an exhaust chamber, and an insert member. The pipe member has two open ends and an inner diameter uniform over its entire length. The first open end of the pipe member is closed, and the second open end thereof is connected to the exhaust chamber. The insert member is located within the pipe member such that it and the pipe member define a combustion chamber within the pipe member, close to the first end thereof, and also an exhaust passage connecting the combustion chamber to the exhaust chamber and having a cross section area smaller than that of the combustion chamber.

That portion of the metal pipe member in which the insert member is inserted forms a tail pipe. The tail pipe has the same inner diameter as the combustion chamber. Hence, the tail pipe and the combustion chamber constitute a Helmholtz resonator, and yet the tail pipe has a large heat-transmitting surface. Since the pipe member has an inner diameter which is uniform over its entire length, it can be produced with ease and at low cost. Therefore, the pulse combustion apparatus as a whole can be manufactured at low cost.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
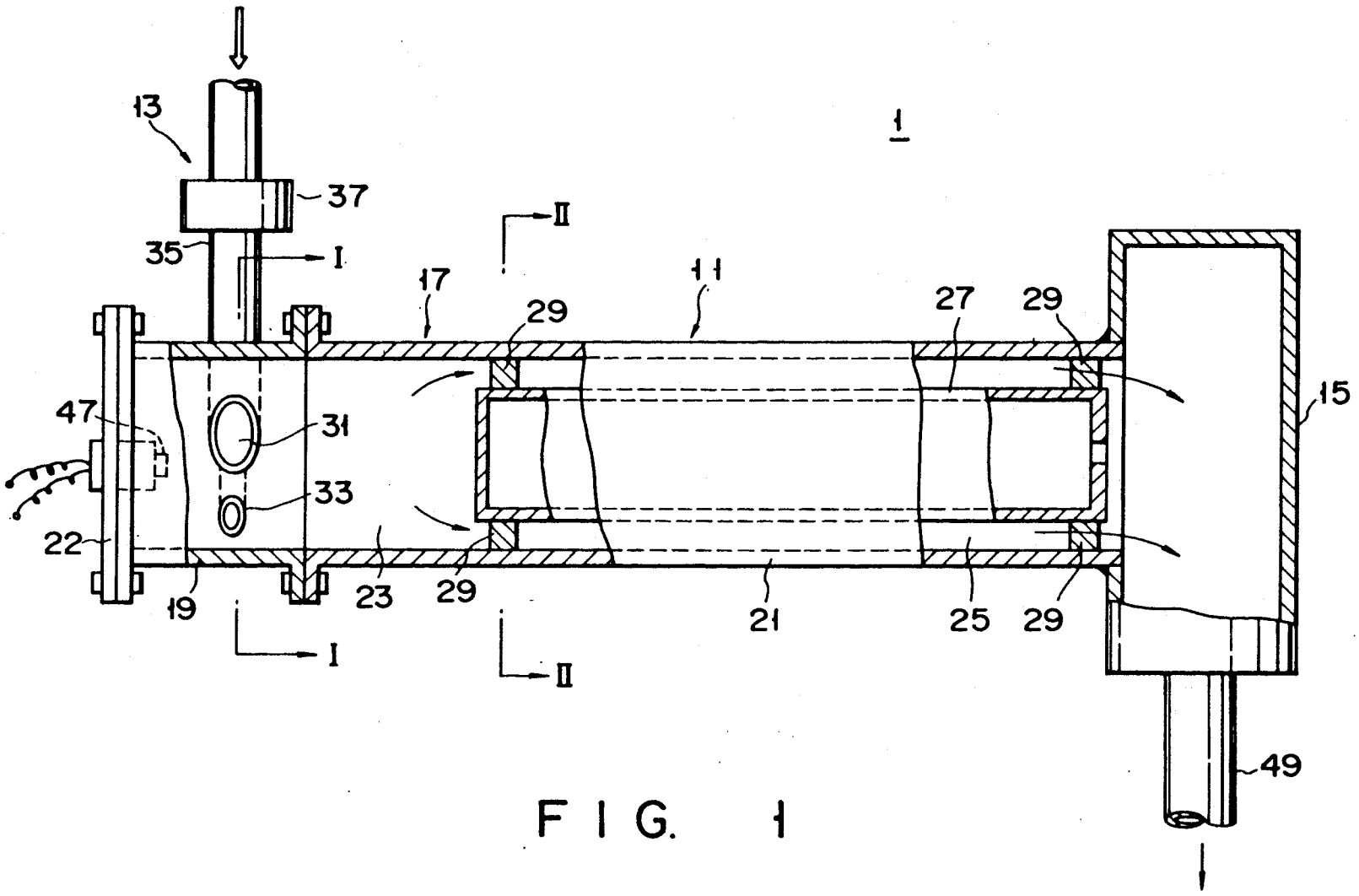
FIG. 1 is a partly sectional view showing a pulse combustion apparatus according to a first embodiment of the invention.

FIG. 1 illustrates a single-barrel pulse combustion apparatus 1. As is shown in the figure, the apparatus 1 is made of three major components, i.e., a pulse combustor 11 having an exhaust port, a fuel-air supplying system 13 for supplying fuel and air to the pulse combustor 11, and an exhaust chamber 15 connected to the exhaust port of the pulse combustor.

The pulse combustor 11 has a pipe member 17 whose inner diameter is uniform over its entire length. The member 17 comprises two pipe elements 19 and 21 having the same diameter and connected coaxial. The element 21 is longer than the element 19; it is made of stainless steel, and the pipe element 21 is made of aluminum, by means of extrusion molding. Both pipe elements 19 and 21 may be formed integral, as a single pipe element, in which case the single pipe element is made of aluminum by means of extrusion molding. One open end of the pipe member 17 is covered by an end plate 22, allowing no fluid to flow into the member 17 through this end. The other open end of the pipe member 17 is connected to the exhaust chamber 15.

An insert member 27, which is a metal pipe closed at both ends, is located in the pipe member 17 coaxial therewith, and is secured to the inner periphery of the member 17 by spacers 29 which are welded between the members 17 and 27. The first end of the insert member 27, which has an opening, is positioned in the inlet port of the exhaust chamber 15. The second end of the insert member 27 is spaced away from the end plate 22.

The end plate 22, the inner periphery of the member 17, and the second end thereof define a combustion chamber 23 having a diameter equal to the inner diameter of the pipe member 17. Also, the outer periphery of the insert member 27 and the inner periphery of the pipe member 17 define an exhaust passage 25 which has an annular cross section. This passage 25 connects the combustion chamber 23 to the exhaust chamber 15. The exhaust passage 25 has an annular cross section area which is smaller than the cross section area of the combustion chamber. Therefore, the passage 25 performs the function of a tail pipe. Obviously, the pipe member 17 and the insert member 27 constitute a Helmholtz resonator.

Figure 2:
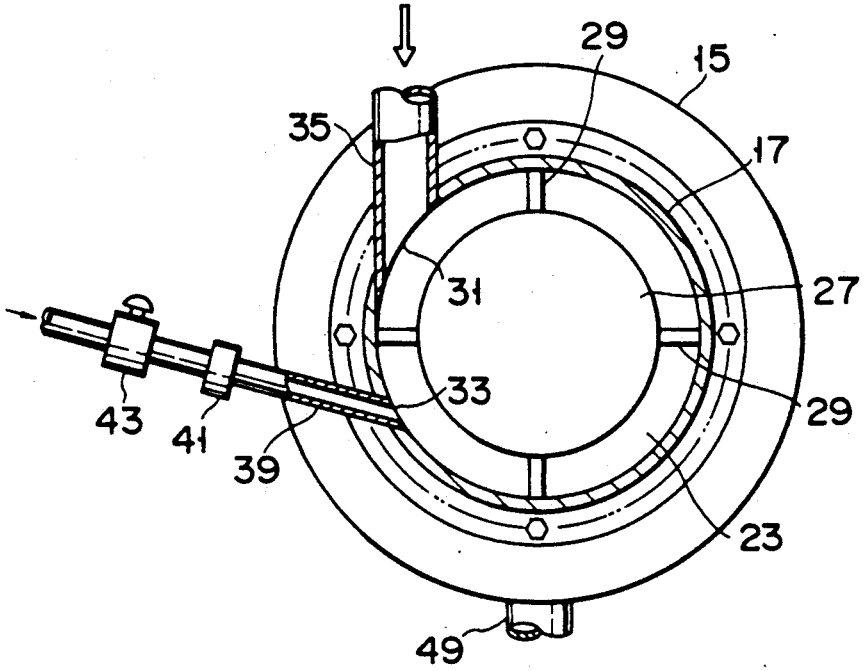
FIG. 2 is a cross-sectional view of the apparatus, taken along line I—I in FIG. 1.

As is shown in FIG. 2, an air intake port 31 and a fuel intake port 33 are made in that portion of the pipe member 17 which defines the combustion chamber 23. One end of an intake pipe 35 is connected to the air intake port 31. The other end of the pipe 35 is connected by a flapper valve 37 (FIG. 1) to a blower (not shown). One end of a fuel intake pipe 39 is connected to the fuel intake port 33. The other end of the pipe 39 is connected to a fuel gas source (not shown) by a flapper valve 41 and a manual valve 43. The flapper valves 37 and 41 have a valve plate which automatically moves to an open position when the pressure in the combustion chamber 23 decreases, and remains in that position as long as the pressure in the chamber 23 is low.

Figure 3:
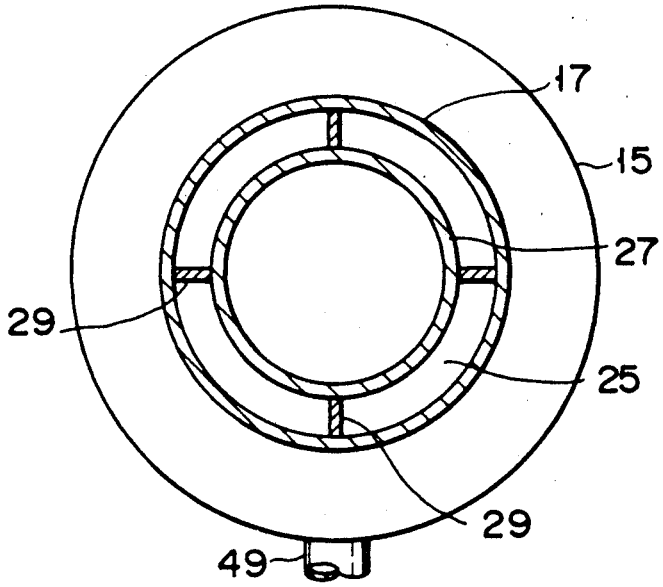
FIG. 3 is a cross-sectional view of the apparatus, taken along line II—II in FIG. 1.

As is shown in FIG. 1, an ignitor 47 is fitted in the hole made in the end plate 22. As is illustrated in FIGS. 1, 2, and 3, an exhaust pipe 49 is connected to the exhaust chamber 15.

The pulse combustion apparatus 1 described above intermittently repeats explosive combustions of the fuel gas, in the same way as the conventional pulse combustion apparatus.

As the fuel gas explodes intermittently in the combustion chamber, it changes into high-temperature, high-pressure combustion gas. The combustion gas moves back and forth in the exhaust passage formed between the pipe member 17 and the insert member 27, as in a Helmholtz resonator, and then flows into the exhaust chamber 15. The gas is then discharged into the atmosphere through the exhaust pipe 49.

That portion of the pipe member 17 which, with the insert member 27, defines the exhaust passage 25, has the same inner diameter as the combustion chamber 23. Therefore, the inner periphery of this portion of the pipe member 17 has a very large area. As the hot combustion gas flows through the passage 25, thence along the inner periphery of this portion of the pipe, heat is transmitted from the gas to the pipe member 17 with high efficiency. In other words, much heat can be collected at the tail pipe. In addition, the combustion gas heats the insert member 27. The insert member 27 radiates heat to the pipe member 17, increasing the efficiency of collecting heat at the tail pipe. Hence, the pulse combustion apparatus need not be equipped with a secondary heat exchanger or, if so, need only have a small capacity secondary heat exchanger. As a result, the pulse combustion apparatus can be small and manufactured at low cost.

Moreover, since the pipe member 17 is a straight hollow cylinder whose inner diameter is uniform over its entire length, it can be easily made. This helps to manufacture the pulse combustion apparatus at low cost.

Figure 4:
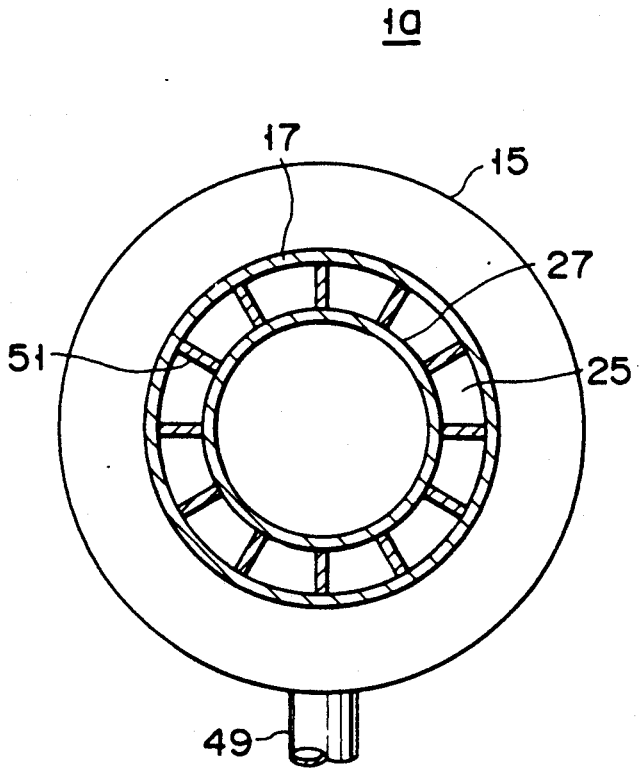
FIG. 4 is a cross-sectional view of a pulse combustion apparatus according to a second embodiment of the invention.

FIG. 4 is a cross-sectional view of the tail pipe of another single-barrel pulse combustion apparatus 1*a* according to the present invention. In this figure, the same numerals designate the same components as those shown in FIG. 3. As is evident from FIG. 4, spacers 51 are interposed between the inner periphery of a pipe member 17 and the outer periphery of an insert member 27, and are spaced apart in the circumferential direction of the members 17 and 27. The spacers 51 extend parallel to the axis of the insert member 27 and are as long as the insert member 27. They are made of a material with high thermal conductivity, and are welded to the pipe member 17 and the insert member 27. Located between the members 17 and 27 and made of thermally conductive material, the spacers 51 function as fins for collecting heat from the combustion gas flowing through an exhaust passage 25 defined by the members 17 and 27. This also serves to increase the efficiency of heat collection at the tail pipe.

Figure 5:
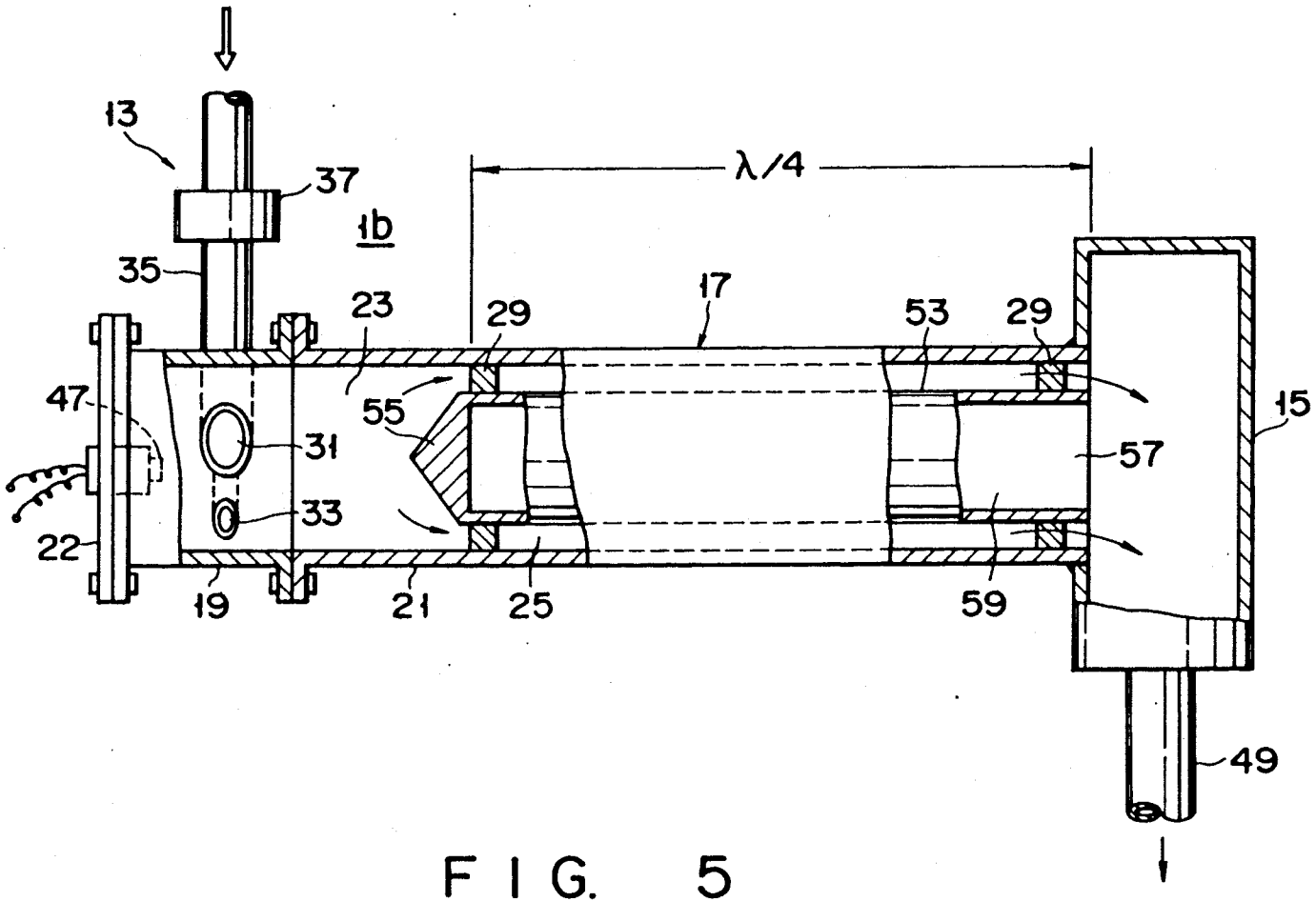
FIG. 5 is a partly sectional view showing a pulse combustion apparatus according to a third embodiment of the invention.

FIG. 5 is a sectional view illustrating another single-barrel pulse combustion apparatus 1*b* according to the present invention. In this figure, the same numerals denote the same components as those shown in FIG. 1. The pulse combustion apparatus 1*b* is characterized in that an insert member 53, having a closed end 55 and an open end 57, is inserted in the pipe member 17 such that it defines a combustion chamber 23 and an exhaust passage 25 in the pipe member 17.

The insert member 53 has its closed end 55 located near the combustion chamber 23, and its open end 57 located near an exhaust chamber 15. The closed end 55 is cone-shaped, ensuring a smooth flow of exhaust gas from the combustion chamber 23 into an exhaust passage 25. The cylindrical space 59 in the member 53 has a length equal to a quarter of the wavelength ($\lambda$) of pulse combustion oscillation.

The pulse combustion apparatus 1*b* is advantageous in two respects. First, heat can be collected at the tail pipe with high efficiency. Second, since the pressure waves returning from the space 59 into the exhaust chamber 15 are 180° out of phase with respect to the pressure waves within the chamber 15, they reduce the the amplitude of the waves within the chamber 15, thereby decreasing the amount of noise generated by the apparatus.

Figure 6:
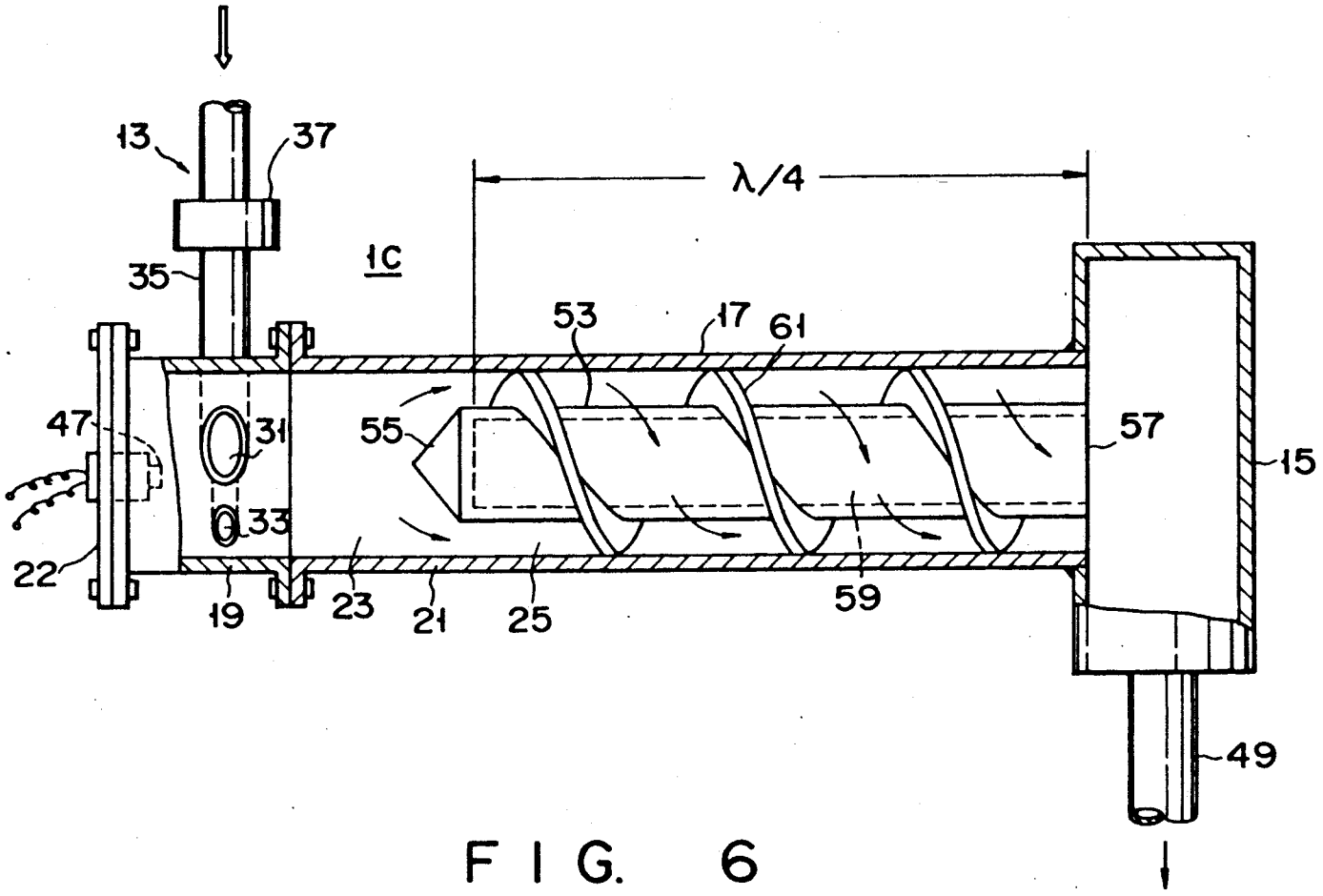
FIG. 6 is a partly sectional view showing a pulse combustion apparatus according to a fourth embodiment of the invention.

FIG. 6 illustrates still another single-barrel pulse combustion apparatus 1*c* according to this invention. In FIG. 6, the same numerals represent the same components as those shown in FIG. 5. The apparatus 1*c* is characterized by the use of a spiral spacer 61 made of metal and interposed between the inner periphery of a pipe member 17 and the outer periphery of an insert member 53, thus defining a spiral exhaust passage 25. The spacer 61 is welded to both the pipe member 17 and the insert member 53.

As the hot exhaust gas flows through the exhaust passage 25, which is spiral by virtue of the presence of the spiral spacer 61, it creates turbulence. Therefore, heat is transmitted from the gas to the pipe member 17 with high efficiency.

Figure 7:
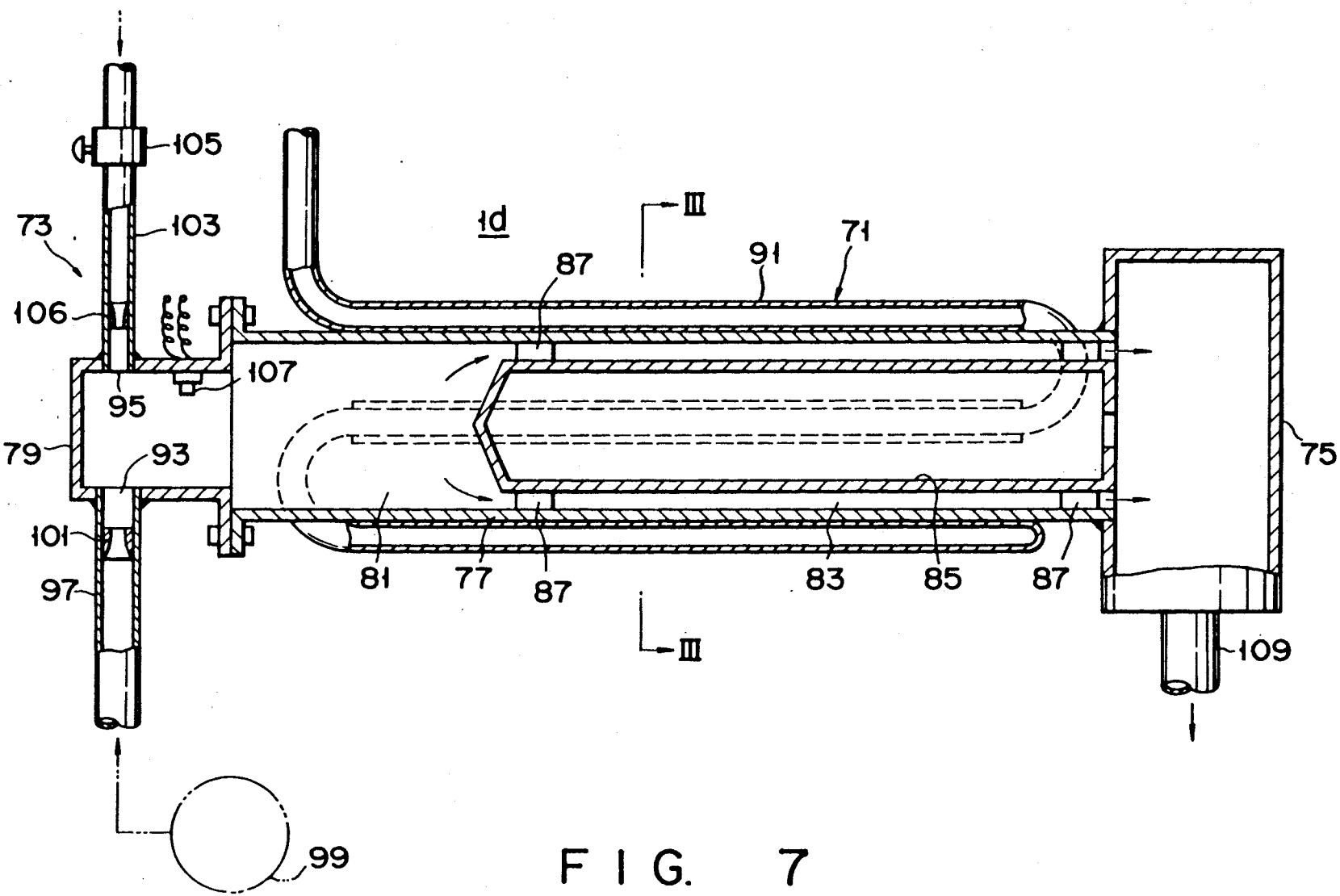
FIG. 7 is a partly sectional view showing a pulse combustion apparatus according to a fifth embodiment of the invention.

FIG. 7 is a sectional view showing another single-barrel pulse combustion apparatus 1*d* according to this invention. This apparatus 1*d* comprises three main components, i.e., a pulse combustor 71 having an exhaust port, a fuel-air supplying system 73 for supplying fuel and air to the pulse combustor 71, and an exhaust chamber 75 connected to the exhaust port of the pulse combustor.

The pulse combustor 71 has a pipe member 77 whose inner diameter is uniform over its entire length. The member 77 is open at both ends and is made of aluminum, by means of extrusion molding. A hollow cylinder 79, which is closed at one end and designed to preliminarily mix air and fuel, is connected at the open end to one end of the pipe member 77 and is coaxial with the pipe member 77. The other open end of the pipe member 77 communicates with the exhaust chamber 75.

An insert member 85, which is a metal pipe closed at both ends, is located in the pipe member 77, coaxial therewith, and is secured to the inner periphery of the member 77 by spacers 87 which are welded to the members 77 and 85. The first end of the insert member 85, which has an opening, is positioned in the inlet port of the exhaust chamber 75. The second end of the insert member 85 is spaced away from the closed end of the hollow cylinder 79.

The inner periphery of the member 77, and the second end of the insert member 85 define a combustion chamber 81 located beside the hollow cylinder 79 and having a diameter equal to the inner diameter of the pipe member 77. Also, the outer periphery of the insert member 85 and the inner periphery of the pipe member 77 define an exhaust passage 83 which has an annular cross section. This passage 83 connects the combustion chamber 81 to the exhaust chamber 75. The cross section area of the exhaust passage 83, which performs the function of a tail pipe, is smaller than the cross section area of the combustion chamber 81. Obviously, the pipe member 77 and the insert member 85 constitute a Helmholtz resonator.

Figure 8:
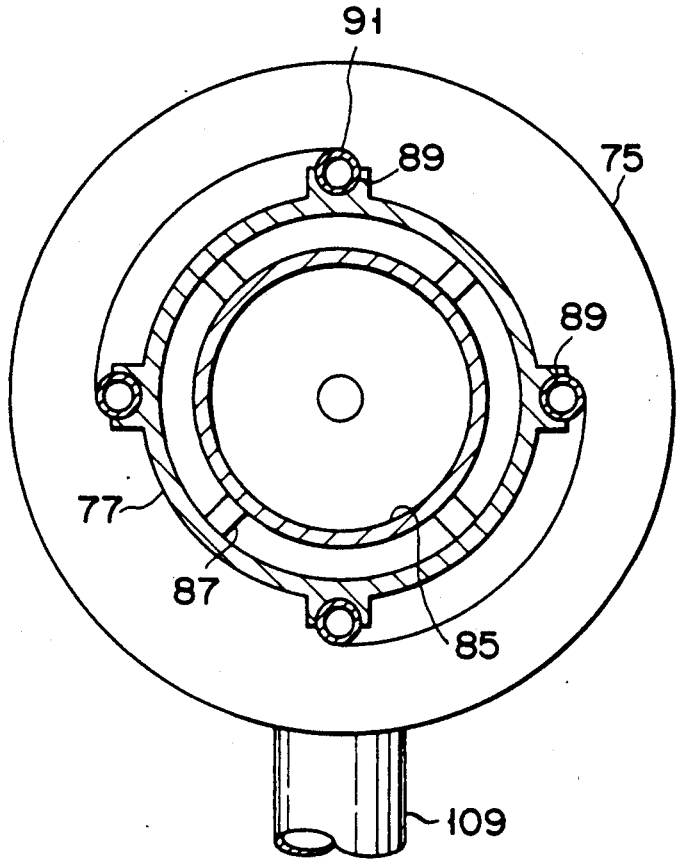
FIG. 8 is a cross-sectional view, taken along line III—III in FIG. 7.

As is shown in FIG. 8, trough-shaped members 89 are formed on the outer periphery of pipe member 77. These members 89 extend parallel to the axis of the pipe member 77 and are spaced apart from one another at regular intervals in the circumferential direction of the member 77. A zig-zag heat-exchanging pipe 91 is fitted in the trough-shaped members 89. A heat-exchanging fluid flows through the pipe 91.

As is shown in FIG. 7, the hollow cylinder 79 has an air intake port 93 and a fuel intake port 95. One end of an intake pipe 97 is connected to the air intake port 93. The other end of the pipe 97 is connected to a blower 99. An aerodynamic valve 101 is located within the air intake pipe 97. The valve 101 is of such a design as to restrict reverse fluid flow more than forward fluid flow. One end of a fuel intake pipe 103 is connected to the fuel intake port 95. The other end of the pipe 103 is connected to a fuel gas source (not shown) by a manual valve 105. An aerodynamic valve 106 is located within the pipe 103. This valve 106 is also designed to restrict reverse fluid flow more than forward fluid flow.

As is shown also in FIG. 7, an ignitor 107 is fitted in a hole made in the wa of the hollow cylinder 79, and an exhaust pipe 109 is connected to the exhaust chamber 75.

The pulse combustion apparatus 1*d* described above intermittently repeats explosive combustions of the fuel gas in the same way as a conventional pulse combustion apparatus.

That portion of the pipe member 77 which together with the insert member 85 defines the exhaust passage 83, has the same inner diameter as the combustion chamber 81. Therefore, the inner periphery of this portion of the pipe member 77 has a very large area. As the hot combustion gas flows through the passage 83, thus along the inner periphery of this portion of the pipe member 77, heat is transmitted from the gas to the pipe member 77 with high efficiency.

Figure 9:
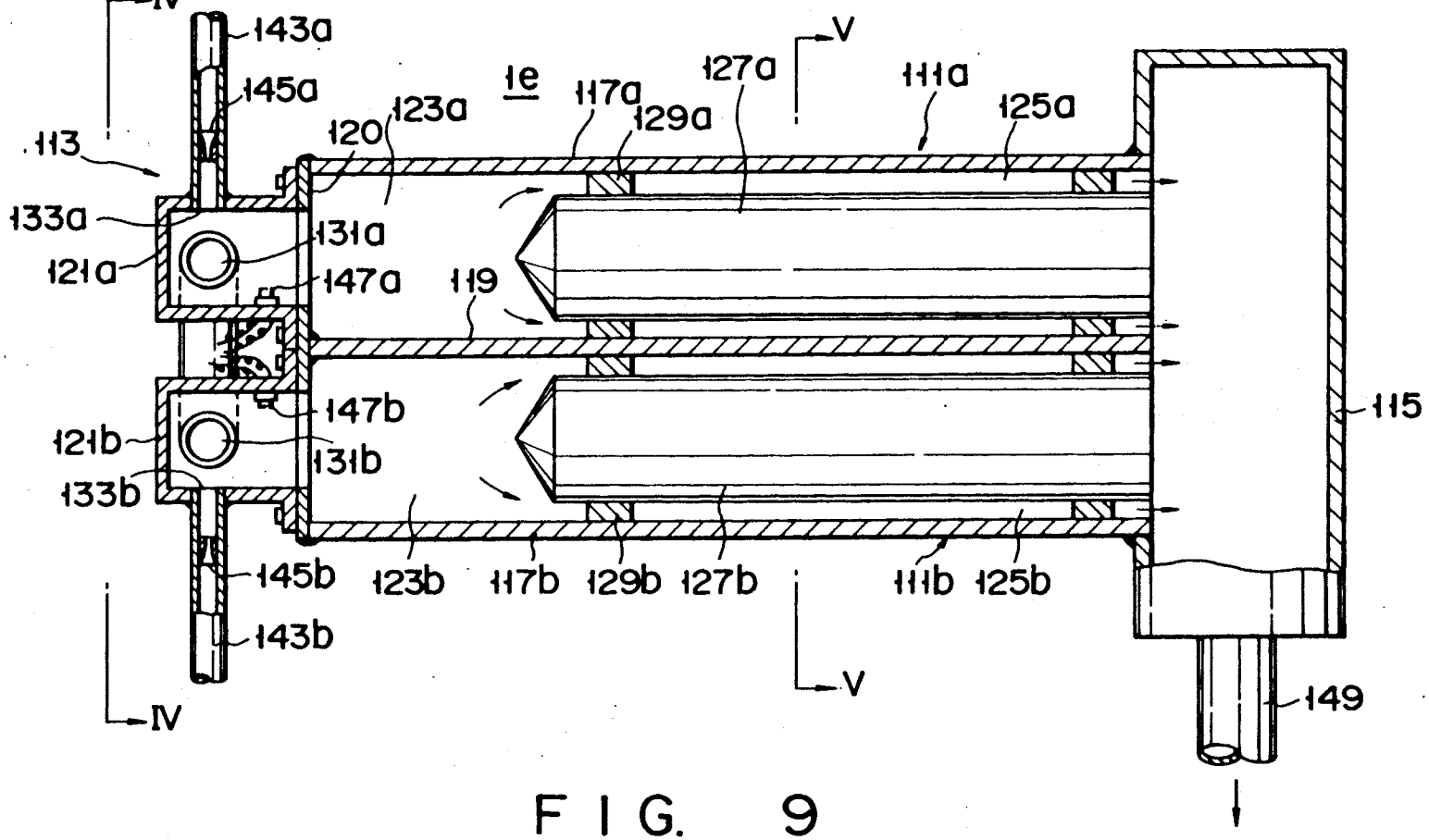
FIG. 9 is a partly sectional view showing a pulse combustion apparatus according to a sixth embodiment of the invention.

FIG. 9 illustrates a two-barrel pulse combustion apparatus 1*e*. This apparatus 1*e* comprises four main components, i.e., two pulse combustors 111*a* and 111*b*, each having an exhaust port, a fuel-air supplying system 113 for supplying fuel and air to the pulse combustors 111*a* and 111*b*, and an exhaust chamber 115 connected to the exhaust ports of both pulse combustors 111*a* and 111*b*.

The pulse combustors 111*a* and 111*b* are arranged parallel to each other. They have a pipe member 117*a* and a pipe member 117*b*, respectively. The pipe members 117*a* and 117*b* are connected together, having a common wall 119. They are made of aluminum and integrally formed by means of extrusion molding. The pipe members 117*a* and 117*b* have two open ends each. Hollow cylinders 121*a* and 121*b*, both closed at one end, are connected at the open end to the first ends of the pipe members 117*a* and 117*b*, respectively, by a connecting plate 120.

These cylinders 121*a* and 121*b* define chambers in which air and fuel are preliminarily mixed. The hollow cylinders 121*a* and 121*b* are coaxial with the pipe members 117*a* and 117*b*, respectively. the pipe members 117*a* and 117*b* communicate, at their other ends, with the exhaust chamber 115.

Insert members 127*a* and 127*b*, both being metal pipes closed at both ends, are located with in and coaxial to the pipe members 117*a* and 117*b*, respectively. The insert member 127*a* is secured to the inner periphery of the member 117*a* by spacers 129*a* which are welded between the members 117*a* and 127*a*. The first end of the insert member 127*a*, which has an opening, is positioned in the inlet port of the exhaust chamber 115. The second end of the insert member 127*a* is spaced away from the closed end of the hollow cylinder 121*a*. Similarly, the insert member 127*b* is secured to the inner periphery of the member 117*b* by spacers 129*b* which are welded between the members 117*b* and 127*b*, the first end of the insert member 127*b*, having an opening, is positioned in the inlet port of the exhaust chamber 115, and the second end of the insert member 127*b* is spaced away from the closed end of the hollow cylinder 121*b*.

The inner periphery of the member 111*a*, and the second end of the insert member 127*a* define a combustion chamber 123*a* located beside the hollow cylinder 121*a* and having a diameter equal to the inner diameter of the pipe member 111*a*. Also, the outer periphery of the insert member 127*a* and the inner periphery of the pipe member 111*a* define an exhaust passage 125*a* which has an annular cross section. This passage 125*a* connects the combustion chamber 123*a* to the exhaust chamber 115. The cross section area of the exhaust passage 125*a*, which performs the function of a tail pipe, is smaller than the cross section area of the combustion chamber 123*a*. Obviously, the pipe member 111*a* and the insert member 127*a* constitute a Helmholtz resonator.

Further, the inner periphery of the member 111*b* and the second end of the insert member 127*b* define a combustion chamber 123*b* located beside the hollow cylinder 121*b* and having a diameter equal to the inner diameter of the pipe member 111*b*. Also, the outer periphery of the insert member 127*b* and the inner periphery of the pipe member 111*b* define an exhaust passage 125*b* which has an annular cross section. This passage 125*b* connects the combustion chamber 123*b* to the exhaust chamber 115. The cross section area of the exhaust passage 125*b*, which performs the function of a tail pipe, is smaller than the cross section area of the combustion chamber 123*b*. Obviously, the pipe member 111*b* and the insert member 127*b* constitute a Helmholtz resonator.

Figure 10:
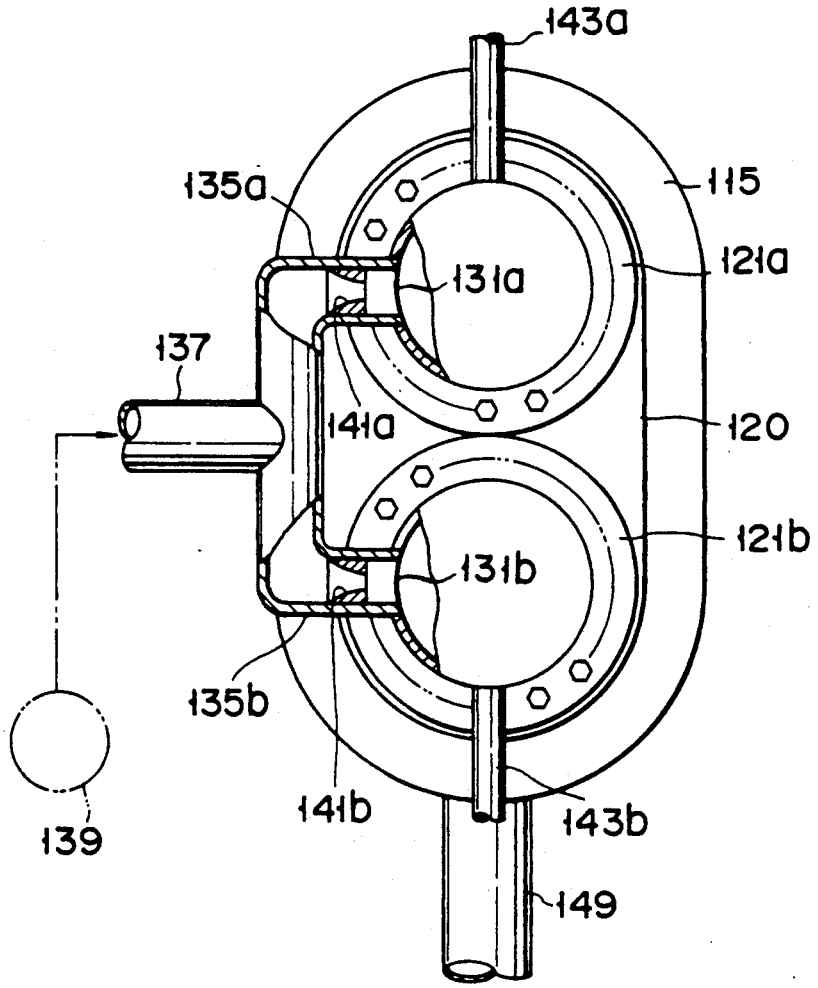
FIG. 10 is a front view of the apparatus shown in FIG. 9, partly broken away along line IV—IV in FIG. 9.

As is shown in FIG. 9, the hollow cylinder 121*a* has an air intake port 131*a* and a fuel intake port 133*a*. Similarly, the hollow cylinder 121*b* has an air intake port 131*b* and a fuel intake port 133*b*. As is shown in FIG. 10, air intake pipes 135*a* and 135*b* are respectively connected at one end to the air intake ports 131*a* and 131*b*, and at the other end to one end of an air-supplying pipe 137. The other end of the pipe 137 is connected to a blower 139.

Aerodynamic valves 141*a* and 141*b* are located within the air intake pipes 135*a* and 135*b*, respectively. Either aerodynamic valve is designed to restrict reverse fluid flow more than forward fluid flow. Fuel intake pipes 143*a* and 143*b* are respectively connected at one end to the fuel intake ports 133*a* and 133*b*, and at the other end to a fuel gas source (not shown) by two manual valves (not shown). Aerodynamic valves 145*a* and 145*b* are located within the fuel intake pipes 143*a* and 143*b*, respectively. These valves 145*a* and 145*b* are also designed to restrict reverse fluid flow more than forward fluid flow.

As is shown in FIG. 9, ignitors 147*a* and 147*b* are fitted in the holes made in the walls of the hollow cylinders 121*a* and 121*b*, respectively, and an exhaust pipe 149 is connected to the exhaust chamber 75.

The explosion of the fuel gas takes place alternately, with a 180° phase difference, in the pulse combustors 111*a* and 111*b* of the the pulse combustion apparatus 1*e*. By virtue of these alternating explosions, the apparatus generates a minimum of noise, which emanates from the exhaust pipe 149.

Further, since that portion of either pipe member (117*a*, 117*b*), which defines the exhaust passage (125*a*, 125*b*), jointly with the insert member (127*a*, 127*b*), has the same inner diameter as the combustion chamber (123*a*, 123*b*), the inner periphery of this portion of the pipe member has a very large area. As the hot combustion gas flows through the exhaust passage, thus along the inner periphery of said portion of the pipe member, heat is transmitted from the gas to either pipe member (117*a*, 117*b*) with high efficiency.

Figure 11:
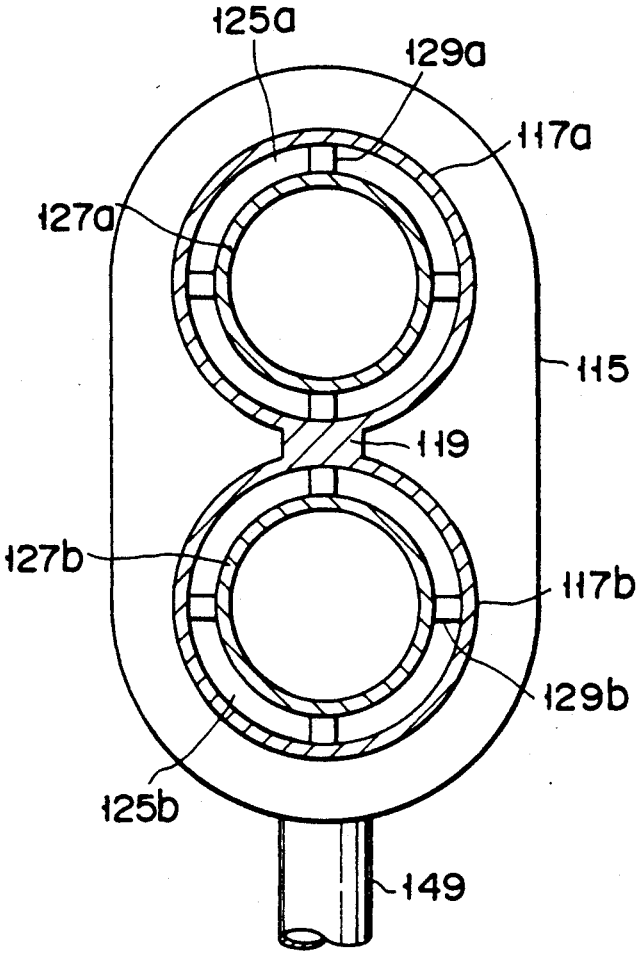
FIG. 11 is a cross-sectional view taken along line V—V in FIG. 9.
Figure 12:
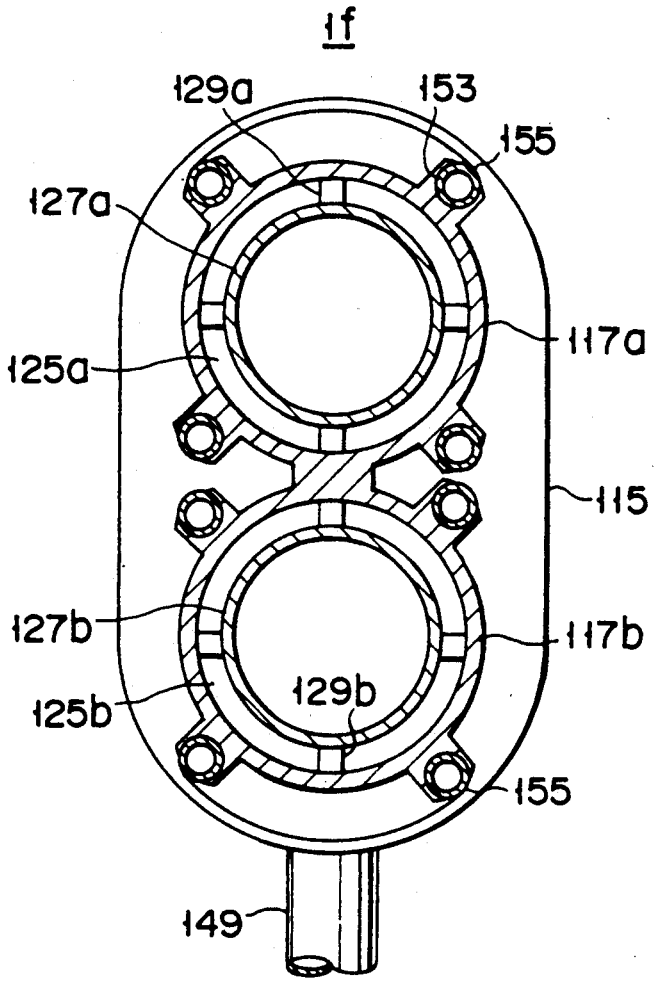
FIG. 12 is a cross-sectional view of a pulse combustion apparatus according to a seventh embodiment of the invention.

FIG. 12 is a cross-sectional view of the tail pipe of another two-barrel pulse combustion apparatus 1*f* according to the present invention. In this figure, the same numerals designate the same components as those shown in FIG. 11. As is evident from FIG. 12, trough-shaped members 153 are formed on the outer peripheries of pipe members 117*a* and 117*b*. These trough-shaped members 153 extend parallel to the axes of both pipe members 117*a* and 117*b* and are spaced apart from one another at regular intervals in the circumferential direction of each pipe member. A zig-zag heat-exchanging pipe 155 is fitted in the trough-shaped members 153 formed on the pipe members 117*a* and 117*b*. A heat-exchanging fluid flows through the heat-exchanging pipes 155, collecting the heat from the combustion chambers.

Figure 13:
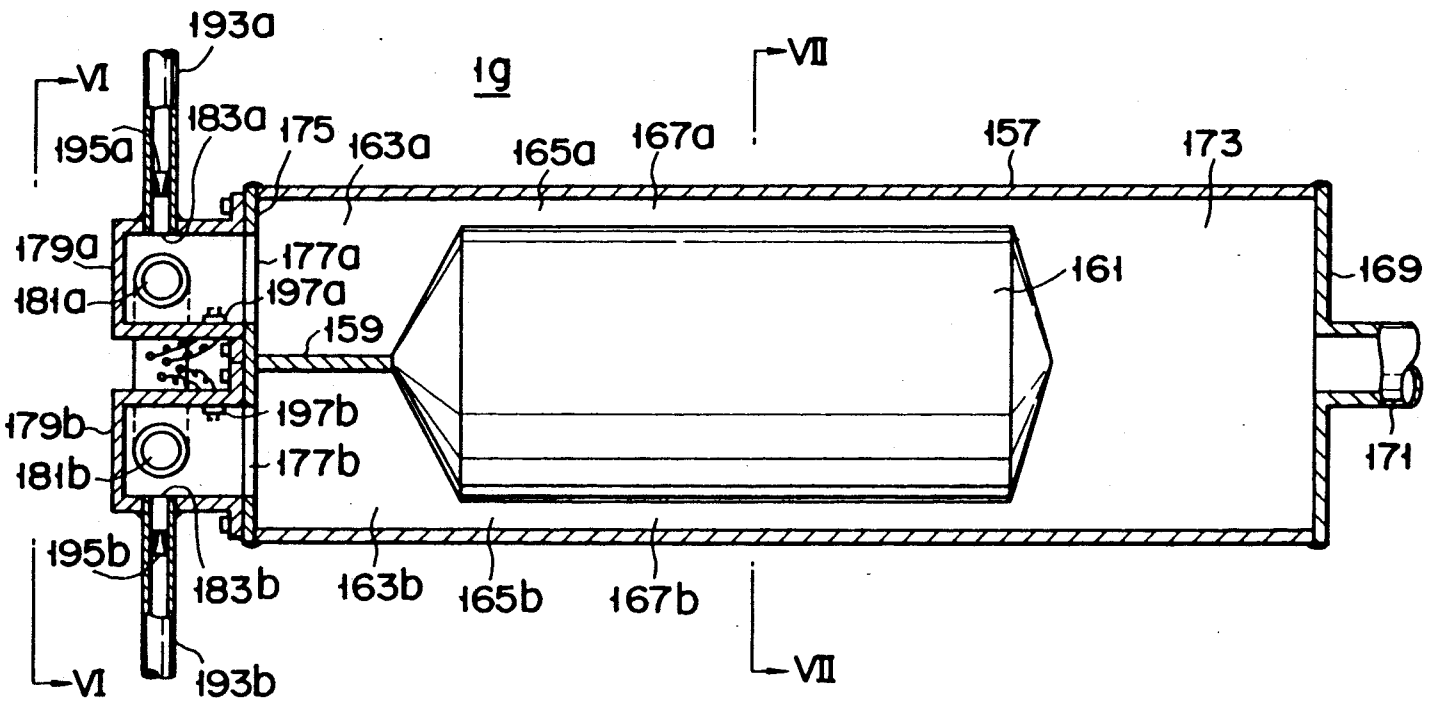
FIG. 13 is a side view, partly broken away and showing a pulse combustion apparatus according to an eighth embodiment of the present invention.
Figure 15:
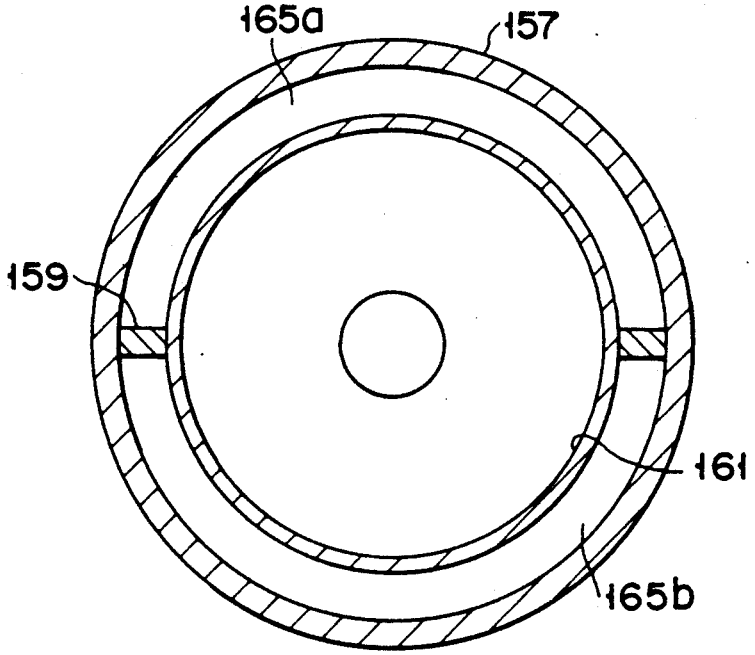
FIG. 15 is a cross-sectional view taken along line VII—VII in FIG. 13.

FIG. 13 illustrates another single-barrel pulse combustion apparatus 1*g* according to the present invention. The apparatus 1*g* has one pipe member 157 whose inner diameter is uniform over its entire length. The pipe member 157 is made of aluminum and formed by means of extrusion molding. The ends of the member 157 are closed by end plates 169 and 175, respectively. A partition 159 is located within the pipe member 157, and extends to the axis of the pipe member 157. A cylindrical insert member 161 is also provided in the member 157. As is shown in FIGS. 13 and 15, the insert member 161 is connected to the partition 159 and the end plate 175, and located coaxial with the pipe member 157.

The partition 159 and the insert member 161 define two pulse combustors 167*a* and 167*b* in the pipe member 157. The first pulse combustor 167*a* has a combustion chamber 163*a* and an exhaust passage 165*a*. The second pulse combustor 167*b* has a combustion chamber 163*b* and an exhaust passage 165*b*. Either combustion chamber has a semi-circular cross section, and either exhaust passage has a half-annular cross section, as can be understood from FIG. 15.

As is shown in FIG. 13, the end plate 169 has a hole in its center portion. An exhaust pipe 171 is connected to the center portion of the plate 169. The space 173 existing in the pipe member 157 and located between the insert member 161 and the end plate 169 serves as an exhaust chamber.

The end plate 175 has two holes 177*a* and 177*b*, opening onto the combustion chambers 163*a* and 163*b*, respectively. Hollow cylinders 179*a* and 179*b* are connected to the end plate 175, coaxial with the holes 177*a* and 177*b*. In these cylinders 179*a* and 179*b*, air and fuel will be preliminarily mixed. An air intake port 181*a* and a fuel intake port 183*a* are made in the peripheral wall of the hollow cylinder 179*a*. An air intake port 181*b* and a fuel intake port 183*b* are made in the peripheral wall of the hollow cylinder 179*b*.

Figure 14:
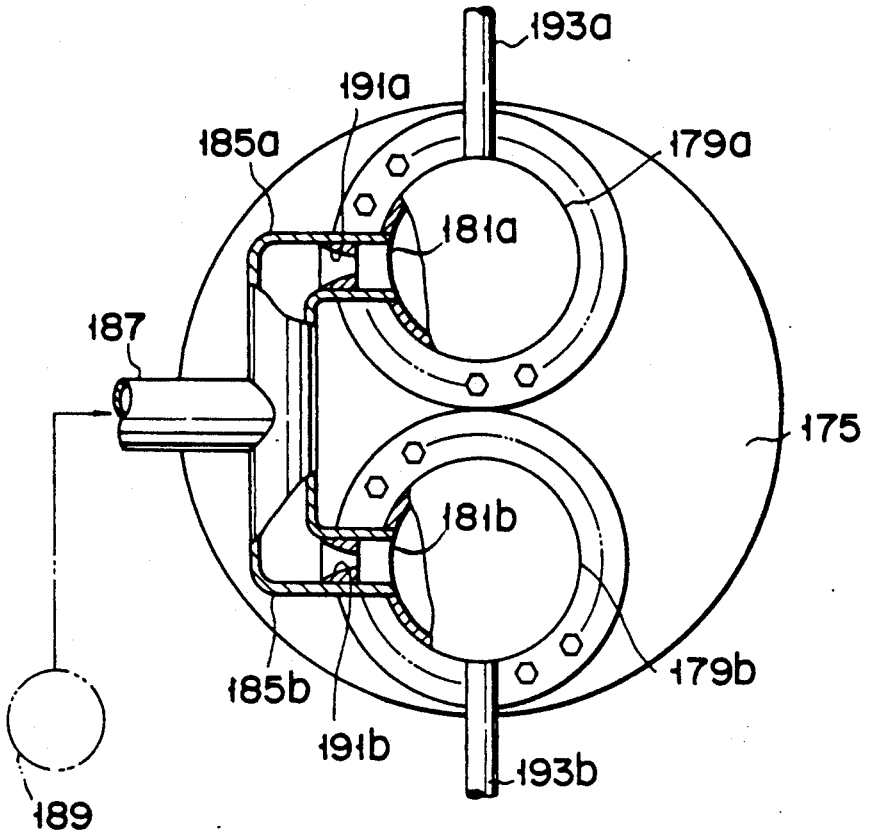
FIG. 14 is a front view of the apparatus shown in FIG. 13, partly broken away along line VI—VI in FIG. 13.

As is shown in FIG. 14, air intake pipes 185*a* and 185*b* are connected, at one end, to the ports 181*a* and 181*b*, and at the other end, to an air supply pipe 187, which in turn is connected to a blower 189. Aerodynamic valves 191*a* and 191*b* are located in the air intake pipes 185*a* and 185*b*. Either valve is designed to restrict reverse fluid flow more than forward fluid flow. Fuel intake pipes 193*a* and 193*b* are connected, at one end, to the fuel intake ports 183*a* and 183*b*, and at the other end, to a fuel gas source (not shown) by means of manual valves (not shown, either). Aerodynamic valves 195*a* and 195*b* are located in the fuel intake pipes 193*a* and 193*b*. Either valve is designed to restrict reverse fluid flow more than forward fluid flow.

As is illustrated in FIG. 13, ignitors 197*a* and 197*b* are fitted in the holes made in the peripheral walls of the hollow cylinders 179*a* and 179*b*.

The explosion of the fuel gas takes place alternately, with a 180° phase difference, in the pulse combustors 167*a* and 167*b* of the the pulse combustion apparatus 1*g*. By virtue of these alternating explosions, the apparatus generates a minimum of noise, which emanates from the exhaust pipe 171.

Further, since those portions of the pipe member 157 which together with the insert member 161 define the exhaust passages 167*a* and 167*b*, have the same inner radius as the combustion chambers 163*a* and 163*b*, the inner peripheries of these portions of the pipe member have a very large area. As the hot combustion gas flows through the exhaust passages, thus along the inner peripheries of said portions of the pipe member, heat is transmitted from the gas to the pipe member 157 with high efficiency.

Additional advantages and modifications will readily occur to those skilled in the art. Therefore, the invention in its broadest aspects is not limited to the specific details and the representative apparatuses shown and described herein. Accordingly, various modifications may be made without departing from the spirit or scope of the general inventive concept as defined by the appended claims and their equivalents.

What is claimed is:

1. A pulse combustion apparatus comprising:

a metal pipe member having a first open end and a second open end and an inner diameter uniform over its entire length;

a closing member closing the first open end of said metal pipe member;

an exhaust chamber connected to the second open end of said metal pipe member;

an insert member located in said pipe member and defining a combustion chamber in that portion of said pipe member which is close to the first open end, and also an exhaust passage which extends along the inner periphery of the pipe member, connect said combustion chamber to said exhaust chamber, and has a cross section area smaller than that of the combustion chamber;

holder means holding said insert member in said metal pipe member;

fuel-supplying means for supplying fuel to said combustion chamber; and air-supplying means for supplying air to said combustion chamber.

2. The apparatus according to claim 1, wherein said insert member is made of metal.

3. The apparatus according to claim 1, wherein said insert member includes a metal pipe having two ends, and at least that end of said metal pipe which is close to aid combustion chamber is closed.

4. The apparatus according to claim 1, wherein said insert member includes a metal pipe having a closed end located near said combustion chamber, an open end located close to said exhaust chamber, and a cylindrical inner space having a length equal to a quarter of the wavelength of pulse combustion oscillation.

5. The apparatus according to claim 1, wherein said holder means comprises a spacer made of metal and interposed between said pipe member and said insert member.

6. The apparatus according to claim 5, wherein said spacer is spiral.

7. The apparatus according to claim 1, wherein said pipe member comprises a plurality of pipe elements connected coaxially.

8. The apparatus according to claim 1, further comprising a heat-exchanging medium guiding pipe thermally connected to the outer periphery of said pipe member.

9. The apparatus according to claim 1, wherein a part of the interior of said pipe member is a part of said exhaust chamber.

10. A pulse combustion apparatus comprising:

a metal pipe member having two open ends and an inner diameter uniform over its entire length;

a partition member fitted within said pipe member and extending in the axial direction of said pipe member, defining two spaces within said pipe member;

closing means closing said two spaces at one end;

an exhaust chamber connected to the other ends of said two spaces;

an insert member located in said pipe member and supported by said partition member, defining two combustion chambers which are located close to the closed ends of said spaces, and also defining two exhaust passages which extend along the inner periphery of said pipe member, connect said combustion chambers to said exhaust chamber, and have a cross sectional area smaller than that of the combustion chambers;

fuel-supplying means for supplying fuel to said combustion chambers; and air-supplying means for supplying air to said combustion chambers.

* * * * *